US007438795B2

(12) United States Patent
Wylie et al.

(10) Patent No.: US 7,438,795 B2
(45) Date of Patent: Oct. 21, 2008

(54) ELECTROCHEMICAL-MECHANICAL POLISHING SYSTEM

(75) Inventors: Ian W. Wylie, Naperville, IL (US); Sriram P. Anjur, Aurora, IL (US)

(73) Assignee: Cabot Microelectronics Corp., Aurora, IL (US)

( * ) Notice: Subject to any disclaimer, the term of this patent is extended or adjusted under 35 U.S.C. 154(b) by 679 days.

(21) Appl. No.: 10/865,027

(22) Filed: Jun. 10, 2004

(65) Prior Publication Data

US 2005/0274627 A1 Dec. 15, 2005

(51) Int. Cl.

| | |
|---|---|
| ***C25F 17/00*** | (2006.01) |
| ***C25D 17/00*** | (2006.01) |
| ***C25D 5/00*** | (2006.01) |
| ***B24B 7/22*** | (2006.01) |
| ***B24B 37/04*** | (2006.01) |
| ***B24B 53/07*** | (2006.01) |
| ***B24B 1/00*** | (2006.01) |

(52) U.S. Cl. ..... 205/663; 205/97; 204/224 R; 204/212; 204/225; 428/131; 428/141; 428/174; 428/209; 438/692; 451/41; 451/285; 451/287; 451/288

(58) Field of Classification Search ..... 204/224 R, 204/212, 225; 205/97, 663; 428/131, 141, 428/174, 209; 438/692; 451/41, 285, 287, 451/288

See application file for complete search history.

(56) References Cited

U.S. PATENT DOCUMENTS 4,841,680 A 6/1989 Hoffstein et al.
5,575,706 A 11/1996 Tsai et al.
5,658,185 A 8/1997 Morgan, III et al.
5,725,420 A 3/1998 Torii et al.
5,807,165 A 9/1998 Uzoh et al.

(Continued)

FOREIGN PATENT DOCUMENTS

WO WO 00/12264 3/2000

OTHER PUBLICATIONS

Woodie, http://www.cnf.cornell.edu/Equipment/CMPPrimer.html, 1-17 (2003).

(Continued)

*Primary Examiner*—Harry D. Wilkins, III
*Assistant Examiner*—Nicholas A. Smith
(74) *Attorney, Agent, or Firm*—Thomas E. Omholt; J. Karl Gross; Steven D. Weseman

(57) ABSTRACT

Provided is a polishing apparatus and polishing pad, intended for polishing a substrate, and designed for improved flow and distribution of a polishing composition to the area of interaction between the pad and substrate. In one aspect, a polishing pad is provided having first and second pluralities of unidirectional pores configured to communicate polishing composition between the top and bottom surfaces of the pad. A cyclic flow of composition is established to continuously renew composition to the area of interaction between the pad and the substrate. In another aspect, a polishing apparatus is provided having a polishing composition transfer region between a polishing pad and a platen. Pores disposed through the pad communicate composition from the transfer region to the top surface. To facilitate directing the composition into the pores, the apparatus includes a plurality of protrusions protruding into the transfer region that are aligned with the pores.

23 Claims, 6 Drawing Sheets

U.S. PATENT DOCUMENTS

| | | | |
|---|---|---|---|
| 5,876,271 | A | 3/1999 | Oliver |
| 5,911,619 | A | 6/1999 | Uzoh et al. |
| 6,277,015 | B1 | 8/2001 | Robinson et al. |
| 6,293,850 | B1 | 9/2001 | Lin et al. |
| 6,346,032 | B1 | 2/2002 | Zhang et al. |
| 6,398,905 | B1 | 6/2002 | Ward |
| 6,413,388 | B1 | 7/2002 | Uzoh et al. |
| 6,413,403 | B1 | 7/2002 | Lindquist et al. |
| 6,419,553 | B2 | 7/2002 | Koinkar et al. |
| 6,478,936 | B1 | 11/2002 | Volodarsky et al. |
| 6,692,338 | B1 * | 2/2004 | Kirchner ..... 451/41 |
| 2002/0102853 | A1 | 8/2002 | Li et al. |
| 2002/0119286 | A1 | 8/2002 | Chen et al. |
| 2002/0130034 | A1 | 9/2002 | Uzoh et al |
| 2003/0092363 | A1 | 5/2003 | Laursen et al. |

OTHER PUBLICATIONS

Robson, http://www.dur.ac.uk/j.h.robson (viscosity.doc.), 1-6 (2003).

* cited by examiner

ELECTROCHEMICAL-MECHANICAL POLISHING SYSTEM

FIELD OF THE INVENTION

This invention pertains to a polishing pad and a polishing apparatus for use generally in polishing a substrate and particularly in electrochemical-mechanical polishing of a substrate.

BACKGROUND OF THE INVENTION

Polishing processes are used in the manufacturing of microelectronic devices to form flat surfaces on semiconductor wafers, field emission displays, and other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. Polishing processes such as chemical-mechanical polishing ("CMP") are used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad supported on the CMP tool's polishing table or platen. The carrier and the wafer are rotated above the rotating polishing pad on the polishing table or platen. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table or platen. To reduce rapid wearing of the polishing pad, improve polishing uniformity, and facilitate slurry introduction between the rotating polishing pad and the wafer, conventional CMP processes use a polishing pad and polishing table that are much larger in size than the wafer to be polished. For example, to polish a 12 inch (about 30 centimeters) wafer, a 34 inch (about 86 centimeters) polishing pad is typically employed.

Recently, a new polishing process referred to as electrochemical-mechanical polishing ("ECMP") has come into common use. ECMP can remove conductive material from a substrate surface by electrochemical dissolution in addition to performing the chemical and mechanical abrasion removal techniques common to CMP processes. The electrochemical dissolution is performed by applying an electrical bias between a cathode and a substrate surface to remove conductive materials from the substrate surface and into a surrounding electrolyte solution. However, conventional polishing pads often restrict the flow of electrolyte solution to the surface of the wafer, resulting in non-uniformity of the applied electric bias and hindering the polishing process. Furthermore, the addition of electrochemical dissolution in the ECMP process allows for reduction of the oscillating motion of the polishing pad and the associated energy expenditure required, as well as allowing reduction of the polishing pad and polishing table size.

Accordingly, there is a need for an improved polishing system that facilitates the introduction of electrolyte solution to the surface of the substrate to be polished. There is also a need for an improved polishing system that enables realization of the advantages of the ECMP process. The invention provides such a polishing system. These and other advantages of the invention, as well as additional inventive features, will be apparent from the description of the invention provided herein.

BRIEF SUMMARY OF THE INVENTION

The invention is directed to improving the communication and flow of polishing composition in the polishing system, thereby resulting in renewing the polishing composition at the area of interaction between a polishing pad and a substrate. In ECMP systems, renewing the polishing composition also promotes ion conduction between the electrodes, thereby improving the electrical bias applied and resulting in a more uniform removal of conductive material from the substrate. Realization in reducing the size of the polishing system's components is also promoted by improving the polishing composition flow. However, while aspects of the invention are directed toward improving ECMP systems, the invention is not intended to be limited to such systems.

In accordance with one aspect of the invention, there is provided a polishing pad having a top surface and a bottom surface that is configured for improved flow of a polishing composition in a polishing process. The polishing composition, for example, may be an electrolyte solution, a polishing slurry, or a combination thereof. The polishing pad includes a first plurality of unidirectional pores disposed therethrough that communicates the polishing composition from the bottom surface to the top surface. Also included is a second plurality of unidirectional pores that communicates the polishing composition from the top surface to the bottom surface. The directionality of the pores is provided by configuring the pores with non-cylindrical cross-sections. Accordingly, when the polishing pad is installed on a polishing apparatus, the polishing composition from a reservoir can be introduced between the polishing table or platen and the polishing pad and then communicated through the unidirectional pores of the first plurality to the top surface the polishing pad that is adjacent the substrate. The polishing composition can then be removed from the top surface via the unidirectional pores of the second plurality.

In accordance with another aspect, the invention provides a polishing apparatus configured for improved flow of a polishing composition. The polishing apparatus includes a polishing pad supported by a platen assembly so as to define a composition transfer region therebetween. The polishing pad includes a top and a bottom surface and a plurality of pores disposed therebetween. Protruding into the composition transfer region is a plurality of protrusions, each aligned with at least one pore. Accordingly, when the polishing composition is introduced into the composition transfer region, the flow of the composition is redirected by the protrusions into the pores and through the polishing pad. The composition can be used to polish a substrate held adjacent the top surface of the polishing pad by a carrier.

BRIEF DESCRIPTION OF THE DRAWINGS

FIG. 7(*b*) is a top plan cutaway view of an embodiment of the polishing pad overlaying the composition transfer region and the platen.

FIG. 8(*b*) is a cross-sectional view of an embodiment of the polishing pad and platen with the platen having a duct to define the channel.

FIG. 8(*c*) is a cross-sectional view of an embodiment of the polishing pad and platen with the polishing pad having a duct to define the channel.

DETAILED DESCRIPTION OF THE INVENTION

Figure 1:
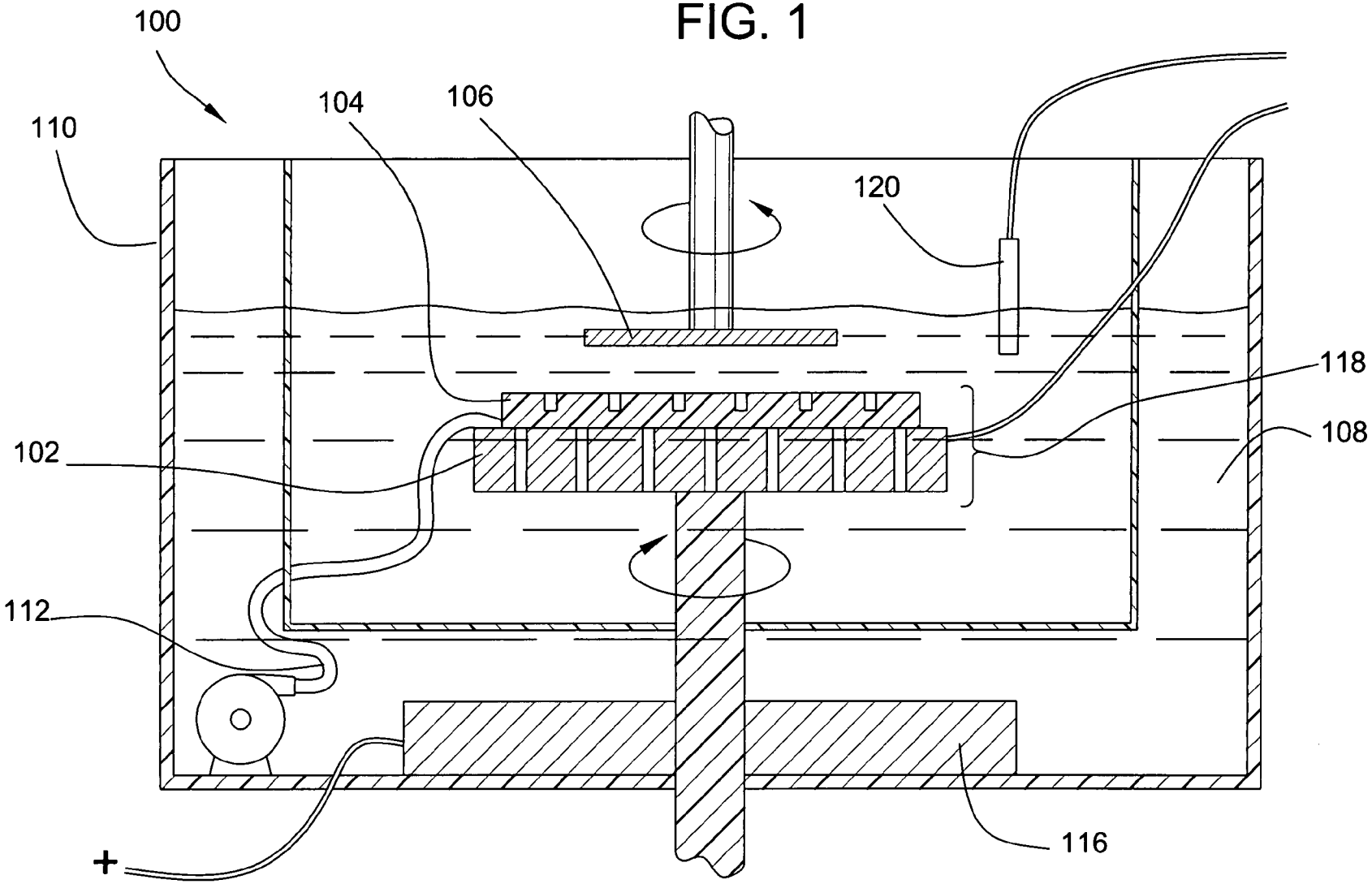
FIG. 1 is a cross-sectional view of a polishing apparatus with a polishing composition and a polishing pad intended for use in polishing a substrate.

Now referring to the drawings, wherein like numerals refer to like elements, there is illustrated in FIG. 1 an example of a polishing apparatus 100 for use in electrochemical-mechanical polishing. The polishing apparatus can include a polishing table or platen 102, a polishing pad 104 supported on the platen 102, and a carrier 106 supported above the platen and polishing pad for mounting a substrate to. To engage the polishing operation, the carrier 106 can be rotated and/or orbited with respect to the platen 102, the platen rotated and/or orbited with respect to the carrier, or both can be rotated and/or orbited simultaneously. For storing and delivering the polishing composition 108 to the area of interaction between the polishing pad 104 and the carrier 106, the polishing apparatus can include a chamber or reservoir 10 and a polishing composition delivery system 112 for introducing the polishing composition between the platen and polishing pad. In the illustrated embodiment, the platen 102 and polishing pad 104 are immersed in the polishing composition 108 held within the reservoir 110. However, in other embodiments it is contemplated that the platen and polishing pad are removed from the composition in the reservoir. Furthermore, in other embodiments, the polishing apparatus 100 can be adapted to operate as a chemical-mechanical polishing apparatus with the polishing composition delivery system 112 adapted to deliver a chemical mechanical polishing composition.

In an embodiment wherein the polishing apparatus 100 is configured to operate as an ECMP apparatus, the exemplary polishing apparatus can also include a cathode 116, an anode 118, and a reference electrode 120. The cathode 116 can be positioned at the bottom of the reservoir 110 and is immersed in the polishing composition 108. It will be appreciated that in this embodiment the polishing composition should at least function as an electrolytically conductive fluid, preferably with a maximum resistance value of about 1000 ohms. The anode 118 can concurrently function as the platen 102, as the polishing pad 104, or be positioned at some other location. The reference electrode 120 is also preferably disposed within the polishing composition 108. In order to provide the appropriate electrical bias for carrying out the ECMP process, the cathode, anode, and electrode are in electrical communication with a suitable power source.

Figure 2:
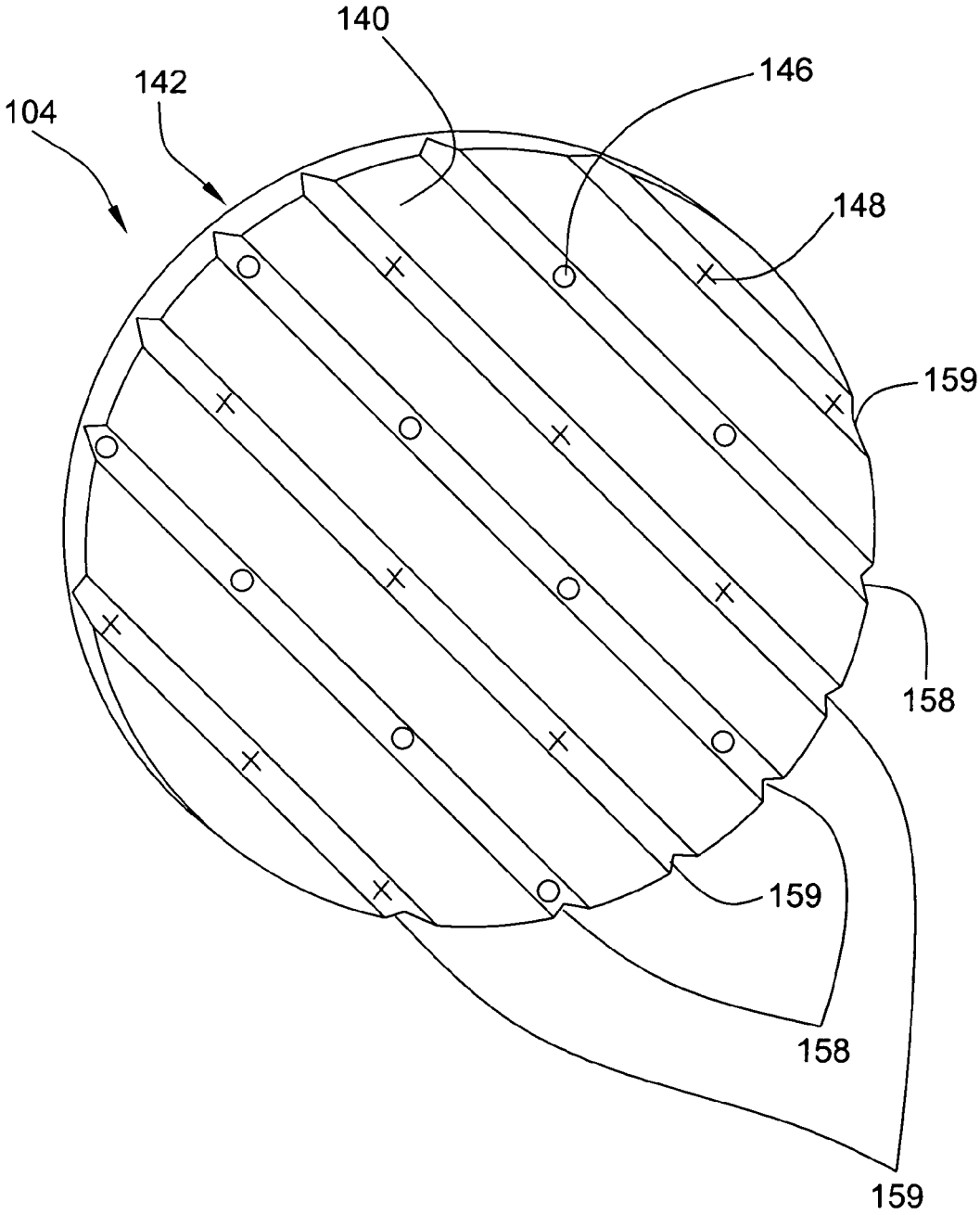
FIG. 2 is a top perspective view of an embodiment of the polishing pad with a first and a second plurality of pores.

Referring to FIG. 2, there is illustrated a polishing pad 104 intended for use with the polishing apparatus 100. The polishing pad 104 includes a top surface 140 and an opposing bottom surface 142. The top surface 140 can function as a polishing surface against which a substrate can be urged and the bottom surface 142 is intended to be supported by the polishing table or the platen. The illustrated polishing pad 104 is shown with a circular outline, but, as will be appreciated, other shapes and outlines can readily be used and the inventive polishing pad is not limited to any particular shape or outline.

As illustrated in FIG. 2, the polishing pad 104 includes a first plurality of pores 146 and a second plurality of pores 148 that are disposed between the top and bottom surfaces 140, 142. In a typical polishing operation, liquid polishing composition is introduced between the bottom surface 142 and the polishing table or platen on which the bottom surface is supported. The polishing composition is introduced under pressure via the delivery system 112 illustrated in FIG. 1, though, in other embodiments, the polishing composition may be un-pressurized. Referring to FIG. 2, in accordance with an aspect of the invention, to supply polishing composition to the top surface that may be adjacent a substrate, the pores of the first plurality 146 are physically configured to communicate the composition from the bottom surface 142 to the top surface 140 in a unidirectional manner. To remove the polishing composition from the top surface 140, the pores of the second plurality 148 are physically configured to communicate polishing composition from the top surface 140 to the bottom surface 142, also in a unidirectional manner. Thus, the pores of the first and second plurality 146, 148 promote a cyclic flow of polishing composition through the polishing pad, thereby facilitating renewal of the polishing composition at the area of interaction between the top surface and the substrate. Additionally, in ECMP processes, this promotes uniform ion conduction between the anode and the cathode thereby facilitating the ECMP dissolution of conductive materials from the substrate.

For purposes of the inventive polishing pad, the term unidirectional means that the particular pore is physically configured to encourage communication of the polishing composition from one surface of the pad towards the opposite surface while substantially impeding communication in the reverse direction. It is not necessary that the unidirectional pores absolutely prevent all flow in any direction other than the intended direction. Furthermore, referring to FIG. 2, the pores of the first and second pluralities 146, 148 are illustrated in an alternating, grid-like pattern. However, the pores can be arranged in any suitable manner and the illustrated grid-like pattern is not intended as a limitation.

Figure 3:
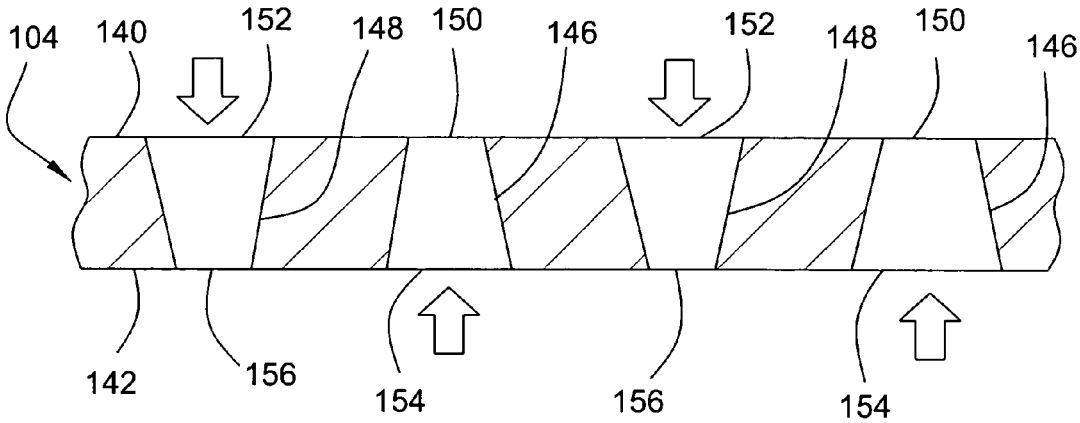
FIG. 3 is a cross-sectional view of an embodiment of the polishing pad including the first and second plurality of pores each having a tapered shape with arrows indicating the direction of polishing composition flow into the pores.

To physically configure the pores to provide unidirectional communication, the pores have a non-cylindrical cross-section or shape. For example, referring to FIG. 3, at least one of the pores of the first plurality 146, and preferably more than one pore (e.g. about 5% or more of the total first plurality of pores, about 10% or more of the total first plurality of pores, about 25% or more of the total first plurality of pores, about 50% or more of the total first plurality of pores, about 75% or more of the total first plurality of pores, or about 90% or more of the total first plurality of pores), taper inwardly as the pore or pores are disposed between bottom surface 142 and the top surface 140. At least one of the pores of the second plurality 148, and preferably more than one pore (e.g. about 5% or more of the total second plurality of pores, about 10% or more of the total second plurality of pores, about 25% or more of the total second plurality of pores, about 50% or more of the total second plurality of pores, about 75% or more of the total second plurality of pores, or about 90% or more of the total second plurality of pores), is oppositely oriented so that it tapers outwardly as the pore or pores are disposed between the bottom surface 142 and the top surface 140. Accordingly, the intersection of the first pores 146 with the top surface 140 forms smaller first apertures 150 while the intersection of the second pores 148 and the top surface 140 forms larger second apertures 152. Similarly, the intersection of the first pores 146 with the bottom surface 142 forms larger third apertures 154 while the intersection of the second pores 148 with the bottom surface 142 forms smaller fourth apertures 156.

As will be appreciated by those of skill in the art, the fluid polishing composition introduced at the bottom surface 142 will more likely pass into the larger third apertures 154 than the smaller fourth apertures 156. Similarly, polishing composition at the top surface 140 will more likely pass into the larger second apertures 152 than the smaller first apertures 150. Polishing composition is therefore encouraged to flow from the bottom surface 142 to the top surface 140 via the first plurality of pores 146 and from the top surface to the bottom surface via the second plurality of pores 148. Thus the pores of the first and second pluralities promote renewal of the polishing composition at the top surface.

The size of the pores and the associated large and small apertures can be any suitable size for communicating polishing composition. Preferably, the pores have an average diameter of 200 micrometers or less and, more preferably, have an average diameter of 50 micrometers or less. For example, in a preferred embodiment, the average diameter of the smaller apertures of the first and fourth pluralities is about 10 micrometers or less while the larger apertures of the second and third pluralities is about 30 micrometers or less.

By way of example only, and not as a limitation in any sense, the following calculations are used to develop a series of specifications for a polishing pad that is capable of renewing the polishing composition at the area of interaction between a 200 millimeters diameter substrate and the polishing pad:

1. Calculate the flow necessary to renew the composition film at the area of interaction between the substrate and the polishing pad:
   Wafer area=$\Pi*(10\ cm)^2$=314 $cm^2$;
   Film Vol. (assuming 1 μm film thickness)=314 $cm^2$*0.0001 cm=0.0314 $cm^3$;
   Flow Rate=1.4 $cm^3$/sec (to renew the composition every second)
   (note: flow rate for typical CMP apparatus is approximately 1.67 $cm^3$/sec.)
2. Calculate the number of pores necessary to provide the 0.0314 $cm^3$/sec flow rate (assuming 100 μm diameter pores (i.e., 7.9 $e^{-5}$ $cm^2$) and 0.15 cm thick polishing pad):
   No. of Pores Required=0.0314 $cm^3$/(7.9 $e^{-5}$ $cm^2$*0.15 cm)=approx. 2650 pores;
3. Calculate the total area of the pores required:
   Area of pores required=2650*7.9 $e^{-5}$ $cm^2$=0.20935 $cm^2$;
   Area of 200 mm substrate=314 $cm^2$;
   % of wafer corresponding to pores=0.20935 $cm^2$/314 $cm^2$=0.067%;
4. Calculate the pressure drop (ΔP) generated by pores:
   (note: use Hagen-Poisseulle law: ΔP=q*8*n*L/(Rc)**2; where ΔP=pressure drop;
   q=flow volume; n=fluid viscosity; L=pad thickness; Rc=pore radius)
   ΔP from pores=0.0314 $cm^3$/sec.*8*1.0 cp*0.15 cm/(0.005 cm)**2=1507 dynes/$cm^2$;
   (assuming additional pressure drop from gravity=147 dynes/$cm^2$)
   total ΔP=1507 dynes/$cm^2$+147 dynes/$cm^2$=1654 dynes/$cm^2$=165.4 N/$m^2$≈0.001654 atm (or about 0.168 kPa)

From the foregoing, 0.001654 atm (which is about 0.168 kPa) is a minimal pressure drop for a polishing system to overcome, thereby indicating that the pores can adequately renew the polishing composition at the area of interaction between the substrate and the polishing pad.

Figure 4:
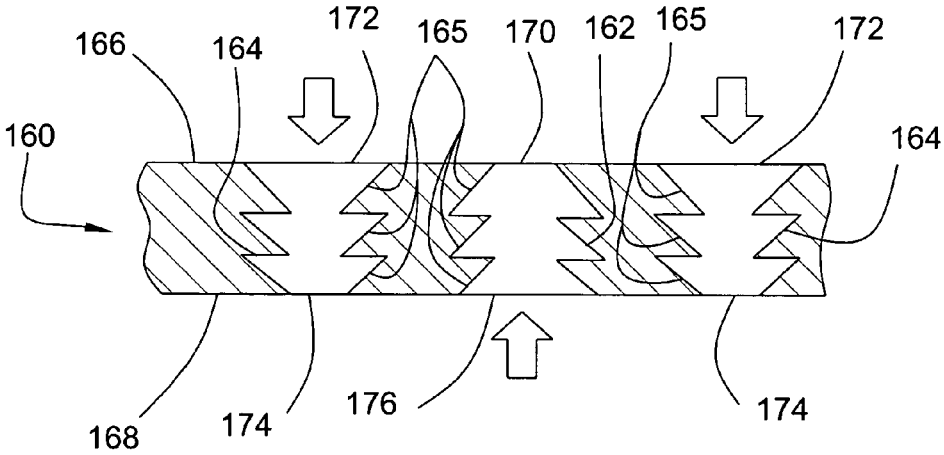
FIG. 4 is a cross-sectional view of an embodiment of the polishing pad including a first and a second plurality of pores each formed as a series of aligned frusto-conical sections with arrows indicating the direction of polishing composition flow into the pores.

The pores of the first and second pluralities need not be tapered in shape to have a unidirectional effect on fluid communication. For example, in the embodiment of the polishing pad 160 illustrated in FIG. 4, at least one of the pores of the first plurality 162, and preferably more than one pore (e.g. about 5% or more of the total first plurality of pores, about 10% or more of the total first plurality of pores, about 25% or more of the total first plurality of pores, about 50% or more of the total first plurality of pores, about 75% or more of the total first plurality of pores, or about 90% or more of the total first plurality of pores), are formed as a series of frusto-conical sections 165 arranged in axial alignment as disposed between the bottom surface 168 and the top surface 166. A base portion of each frusto-conical section 165 of the first plurality of pores 162 is aligned toward the bottom surface 168 while a topmost portion of each frusto-conical section is oriented toward the top surface 166. At least one of the pores of the second plurality 164, and preferably more than one pore (e.g. about 5% or more of the total second plurality of pores, about 10% or more of the total second plurality of pores, about 25% or more of the total second plurality of pores, about 50% or more of the total second plurality of pores, about 75% or more of the total second plurality of pores, or about 90% or more of the total second plurality of pores), are similarly formed by a series of similar frusto-conical sections 165 arranged in an opposing alignment. Preferably, the larger second and fourth apertures 172, 176 are formed by a base portion of a frusto-conical sections 165 while the smaller first and third apertures 170, 174 are formed by a topmost portion of a frusto-conical sections. As will be apparent to those of skill in the art, the arrangement of the frusto-conical sections in the first pores 162 encourages flow from the bottom surface 168 to the top surface 166 while substantially impeding flow in the opposite direction. The arrangement of the frusto-conical sections in the second pores 164 similarly encourages flow from the top surface 166 to the bottom surface 168. Thus, the pores of the first and second pluralities formed with the frusto-conical sections promote renewal of the polishing composition at the top surface.

Figure 5:
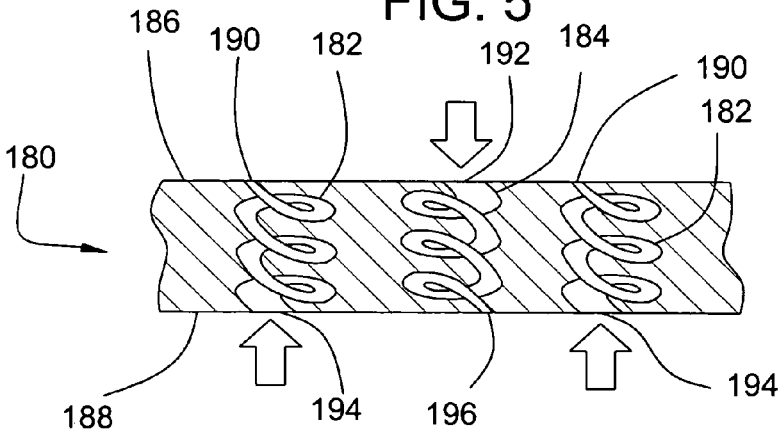
FIG. 5 is a cross-sectional view of an embodiment of the polishing pad including a first and a second plurality of pores each formed as a helical or spiral shape with arrows indicating the direction of polishing composition flow into the pores.

In the embodiment of the polishing pad 180 illustrated in FIG. 5 at least one of the pores of the first plurality 182 and at least one of the pores of the second plurality 184, and preferably more than one pore of each of the first and second pluralities (e.g. about 5% or more, about 10% or more, about 25% or more, about 50% or more, about 75% or more, or about 90% or more of each of the respective total first and second pluralities of pores), are formed as helixes disposed between the bottom surface 188 and the top surface 186. The helical first pores 182 intersecting with the top surface 186 forms the smaller first apertures 190 while the helical first pores intersecting with the bottom surface 188 forms the larger third apertures 194. Likewise, the intersection of the helical second pores 184 with the top surface 186 forms the larger second apertures 192 while the intersection of the helical second pores 184 with the bottom surface 188 forms the smaller fourth apertures 196. The combination of helical paths and the location of the larger and smaller apertures provides the unidirectional character of the pores.

The polishing pad can be made from any suitable material. Typically, polishing pads are made from a polymer resin. Preferably, the polymer resin is selected from the group consisting of thermoplastic elastomers, thermoplastic polyurethanes, thermoplastic polyolefins, polycarbonates, polyvinylalcohols, nylons, elastomeric rubbers, elastomeric polyethylenes, polytetrafluoroethylenes, polyethyleneterephthalates, polyimides, polyaramides, polyarylenes, polyacrylates, polystyrenes, polymethylmethacrylates, copolymers thereof, and mixtures thereof. More preferably, the polymer resin is a thermoplastic polyurethane resin.

The polishing pad can be adapted for CMP processes that utilize chemical-mechanical polishing compositions or the polishing pad can be adapted for use in ECMP processes. When used in ECMP process, the polishing pad can be made from a conductive polymer or, in some embodiments, made from a non-conductive polymer having conductive elements inner-dispersed or embedded therein. The conductive polymer and conductive elements can be formed from any suitable materials. For example, the conductive elements can take the form of particles, fibers, wires, coils, or sheets and made from materials such a carbon and conductive metals such as copper, platinum, platinum-coated copper, and aluminum. Conductive polishing pads can have a maximum resistance value of, for example, 10 ohms.

To provide the pores of the first and second pluralities, any suitable formation method can be employed. For instance, the pores can be formed during the manufacturing process of the polishing pad itself, such as during the molding process of the polymer resin used to produce the polishing pad. Special blowing agents or micro-spheres may be employed to assist in the formation of the pores. The pores can also be formed by any other suitable molding or casting technique. Furthermore, the pores can be formed after molding of the polishing pad through any number of various machining processes and techniques.

Referring to FIG. 2, to further improve the distribution of composition along the top surface 140 of the polishing pad 104, a groove or series of grooves can be formed into the top surface that intersects at least one of the pores. For instance, in the illustrated embodiment, a first series of grooves 158 can be formed that intersect with the first plurality of pores 146 while a second series of grooves 159 can be formed that intersect with the second plurality of pores 148. The grooves 158, 159 assist in transferring the composition to and from the pores to the area of interaction between the top surface and the substrate.

The grooves 158, 159 can have any suitable cross-section, such as a V-shaped cross-section. Other possible cross-sections include U-shaped cross-sections and truncated V-shaped cross-sections. The width of the cross-section can be any suitable width and typically about 0.1 mm to 2 mm. The width of the cross-section may correspond to the average diameters of the apertures with which a particular groove intersects. The depth of the groove can be any suitable depth and may be dependent upon the thickness of the polishing pan and flow rate of the composition. A typical thickness of a polishing pad between the top and bottom surfaces is about 0.1 mm to 10 mm. The grooves 158, 159 can also be formed in any suitable pattern on the top surface 140, such as the alternating series of parallel grooves illustrated in FIG. 2. Other possible patterns include concentric circle patterns or curved patterns.

The polishing pad can be a multi-layered pad having at least a top-layer and a bottom layer. In such an embodiment, the polishing pad of the invention, e.g., polishing pad 104 illustrated in FIG. 2, including the top and bottom surfaces 140, 142 and the first and second pluralities of pores 146, 148, corresponds to the top layer of the multi-layered polishing pad.

Figure 6:
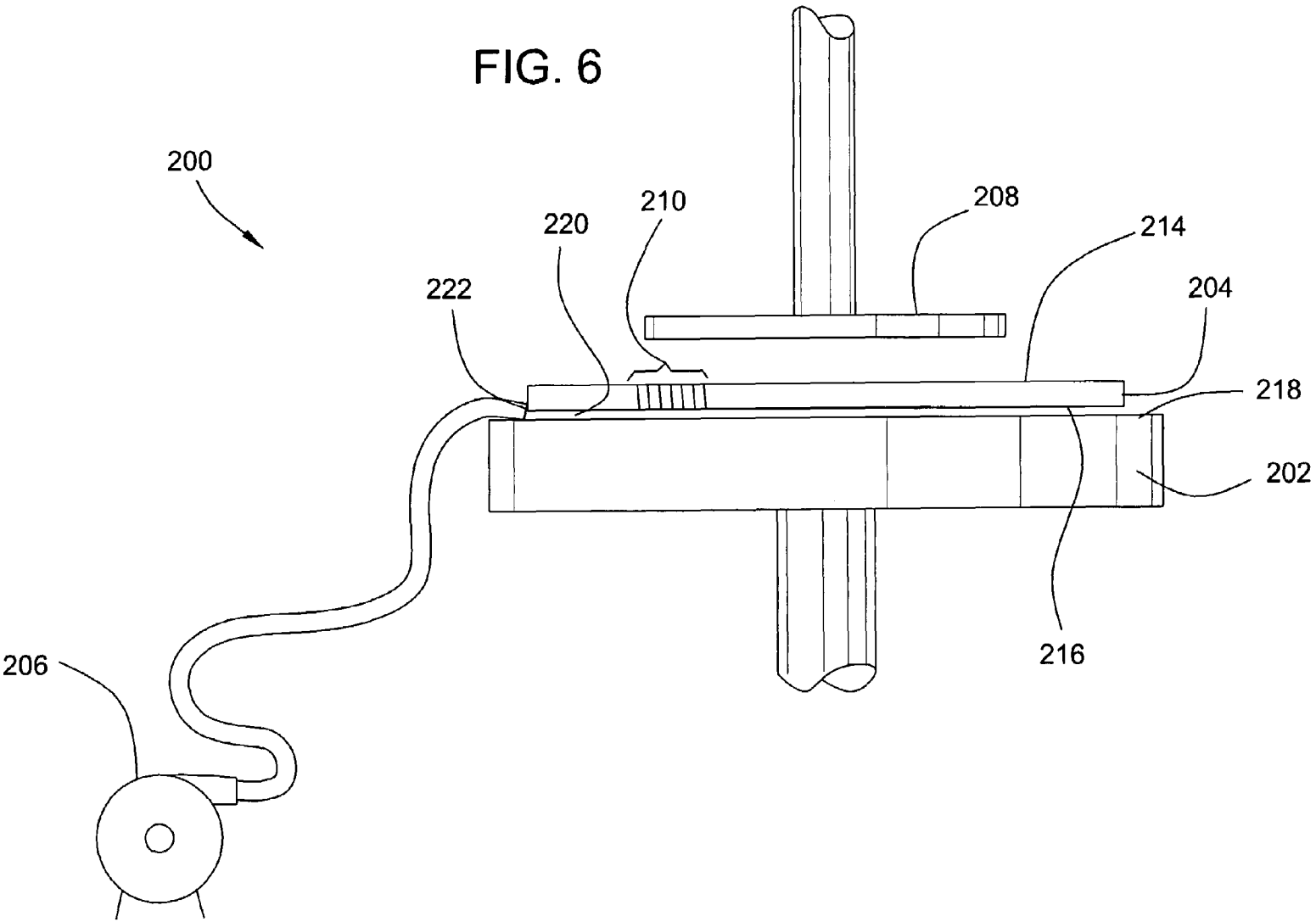
FIG. 6 is a cross-sectional view of an embodiment of a polishing apparatus intended for use in polishing a substrate with a polishing pad overlaying a platen and defining a composition transfer region therebetween.
Figure 7A:
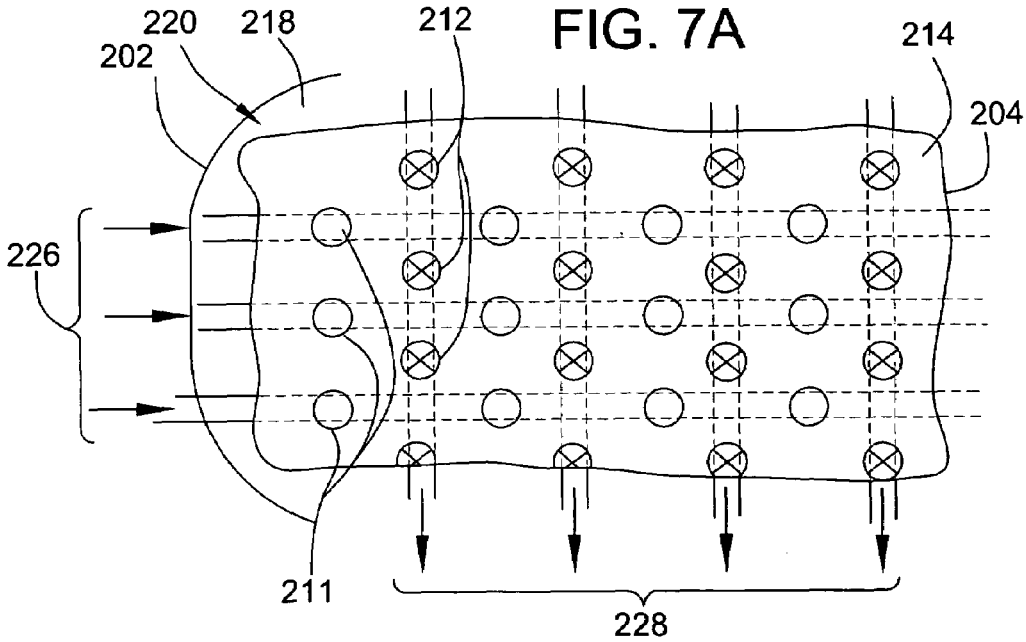
FIG. 7(*a*) is a top plan cutaway view of an embodiment of the polishing pad overlaying the composition transfer region and the platen, where the composition transfer region is composed as a first series of channels and a second series of channels.
Figure 7B:
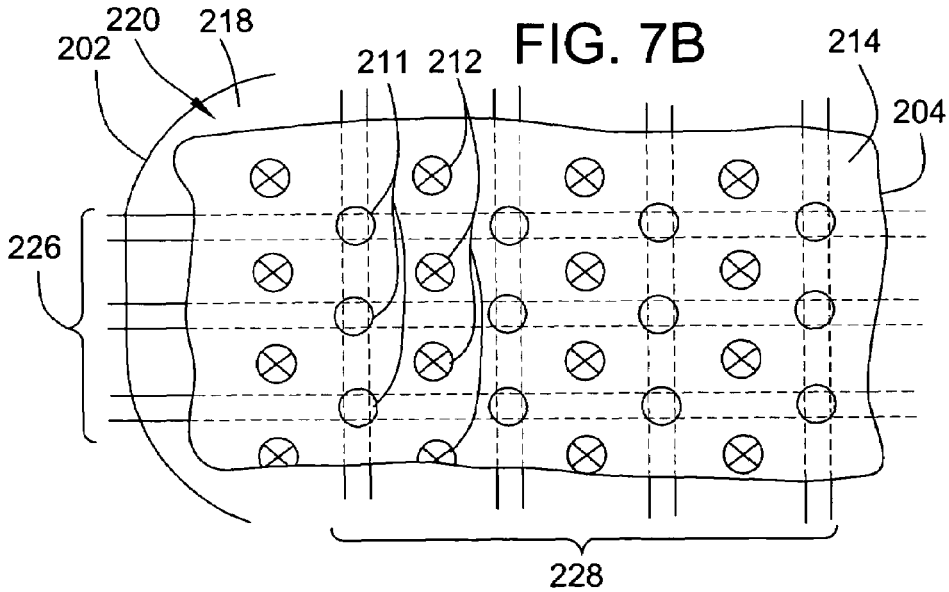
Figure 8A:
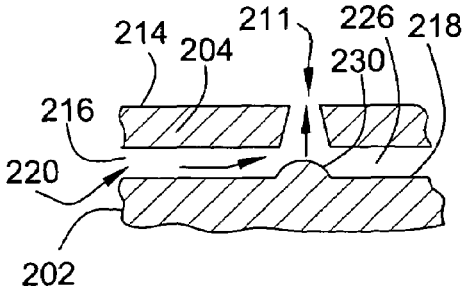
FIG. 8(*a*) is a cross-sectional view of the polishing pad and platen showing a protrusion within a channel defining the composition transfer region.
Figure 8B:
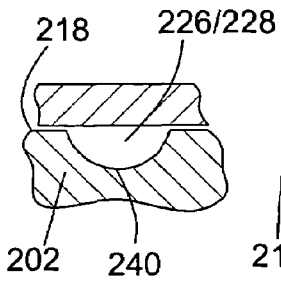
Figure 8C:
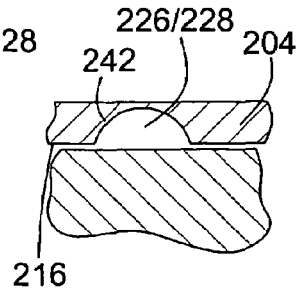

Referring to FIGS. 6 through 8, there is illustrated an example of a polishing apparatus 200 that is designed in accordance with another aspect of the invention. The polishing apparatus 200 includes a polishing table or platen 202 and a polishing pad 204 that is supported on the platen. The polishing pad 204 has a top surface 214, an opposing bottom surface 216, and a plurality of pores 210 disposed between the top and bottom surfaces. The polishing pad and the plurality of pores can be of the same construction as the polishing pad described above or of a different construction altogether. Additionally, to communicate the polishing composition to the pores 210, the bottom surface 216 of the polishing pad is positioned next to a first surface 218 of the platen 202 thereby defining a polishing composition transfer region 220 therebetween. To introduce polishing composition to the transfer region 220, the polishing apparatus 200 also includes a delivery system 206 that delivers polishing composition to a composition inlet 222 that is disposed so as to correspond to the transfer region. For mounting a substrate to be polished, there is also included as part of the polishing apparatus 200 a carrier 208 that is supported above the polishing pad 204. To impart the motion necessary for carrying out the polishing operation, the carrier 208 may be rotated and/or orbited with respect to the polishing pad 204 or the polishing pad and platen 202 may be rotated and/or orbited with respect to the carrier or a combination of both elements may be rotated and/or orbited.

Illustrated in FIG. 7(*a*) is an embodiment of the polishing pad 204 overlaying the transfer region 220. To transfer polishing composition to the pores in an organized fashion, the transfer region 220 is composed of a first plurality of channels 226 and, preferably, a second plurality of channels 228. The first plurality of channels 226 align with pores of a first type 211 that are adapted to communicate polishing composition to the top surface of the pad while the second plurality of channels 228 align with pores of a second type 212 that are adapted to remove polishing composition from the top surface. It will be appreciated that the longitudinal axis of the channels are generally parallel to the plane of the polishing pad and generally normal to the axis of the pores. The channels 226 of the first plurality are in communication with the composition inlet and, preferably, are arranged in parallel with one another. Likewise, the channels 228 of the second plurality are also preferably arranged in parallel with each other and generally normal to the channels 226 of the first plurality.

Illustrated in FIG. 7(*b*) is another embodiment of the polishing pad 204 overlaying the transfer region 220. The transfer region 220 includes a first plurality of generally parallel channels 226 and a second plurality of generally parallel channels 228. The channels of the first and second pluralities 226, 228 are arranged perpendicularly to each other. Located proximate to and in communication with the intersections of the first and second plurality of channels 226, 228 is a pore of the first type 211 that is adapted to communicate polishing composition to the top surface of the pad. The pores of the second plurality 212, which are adapted so that they remove polishing composition from the top surface, are disposed through the pad 204 such that they are not aligned with either the first or second pluralities of channels 226, 228.

Referring to FIG. 8(*a*), there is illustrated in detail a channel 226 of the first plurality (corresponding in part to the transfer region) disposed between the polishing pad 204 and the platen 202. To facilitate communication of the polishing composition from the channel 226 through the pore 211 to the top surface 214 of the polishing pad 204, there is disposed within the channel a plurality of protrusions 230. Each protrusion 230 of the plurality is aligned with a pore 211 and, in the illustrated embodiment, is formed as an integral part of the platen protruding upward into the channel 226. In operation, at least a portion of the polishing composition delivered from the composition inlet is redirected by the protrusion 230 from the channel 226 into the pore 211. Redirecting the polishing composition improves the renewal of the composition at the area of interaction between the substrate and top surface of the pad and, in ECMP applications, promotes uniform ion conduction between electrodes thereby facilitating the ECMP dissolution of conductive materials from the substrate.

Referring to FIG. 7(*a*), another advantage of redirecting the polishing composition is that, in applications in which the composition is pressurized by the delivery system, the redirected composition displaces the composition already located at the top surface of the polishing pad. The displaced polishing composition may enter the pores 212 of the second type and thereby be returned to a reservoir by the second plurality of channels 268, thus further improving renewal of the composition.

Referring to FIG. 7(*b*) an advantage of locating the pores of the first type 211 at the intersections of the first and second pluralities of channels 226, 228 is that the amount of composition communicated to the top surface can be controlled by adjusting the composition flow rate in either of the first plurality of channels or the second plurality of channels. In essence, locating the pores of the first type 211 at the intersections of the first and second pluralities of channels 226, 228 provides for multiple degrees of control over the amount of composition communicated to the top surface.

To provide the channels 226, 228 that correspond to the transfer region, referring to FIG. 8(*b*), there is formed into the first surface 218 of the platen 202 a plurality of ducts 240. Each duct 240 corresponds to and defines at least a portion of one channel 226, 228. Referring to FIG. 8(*c*), in another embodiment the channels 226, 228 are provided by forming the ducts 242 into the bottom surface 216 of the polishing pad 204. The ducts can be formed by any suitable means such as machining or, where appropriate, molding. The ducts can also be of any suitable shape and cross-section, including, as illustrated, hemispherical.

Figure 9:
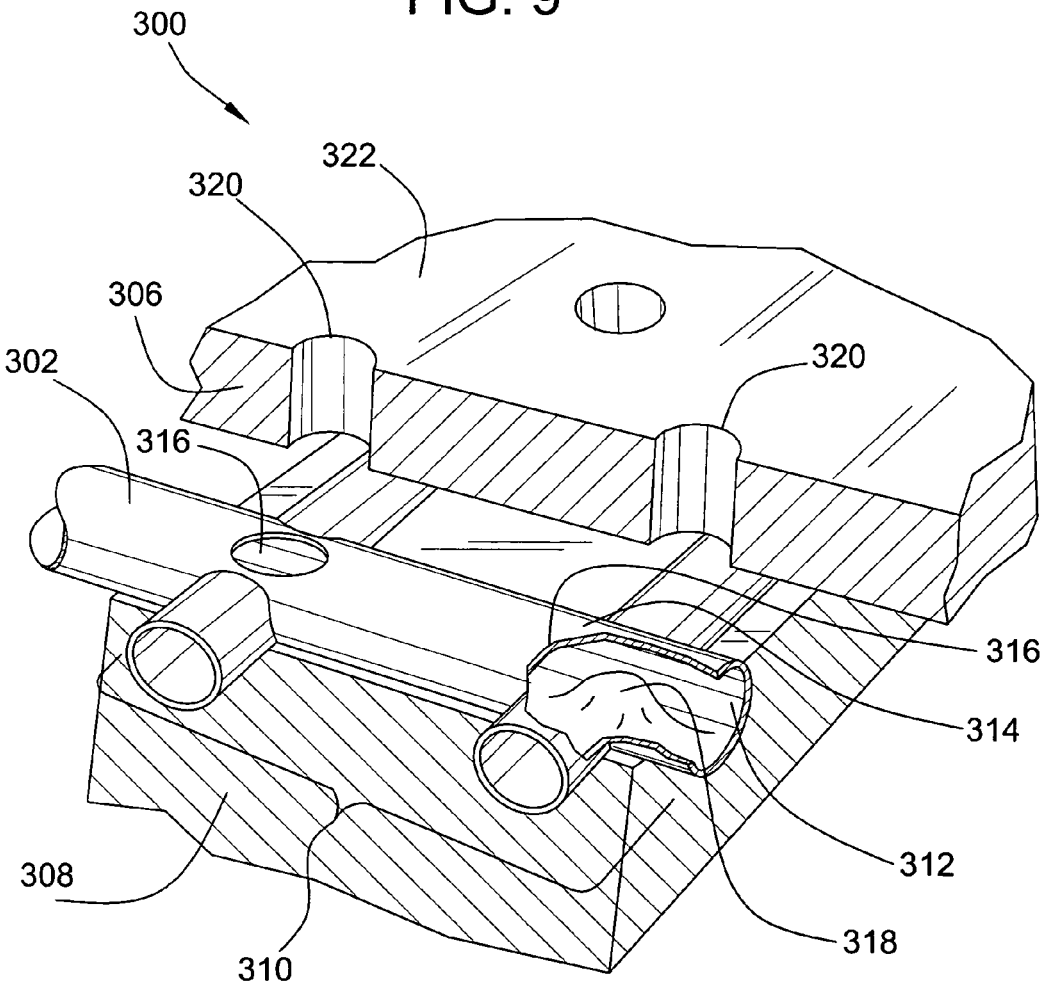
FIG. 9 is a perspective cutaway view an embodiment of a polishing apparatus intended for use in polishing a substrate with a polishing pad overlaying a platen and a composition transfer region composed as a network of composition tubes.

Referring to FIG. 9, in another embodiment of the polishing apparatus 300, the transfer region can correspond to and be defined by a plurality of composition pipes or tubes 302 disposed between the polishing pad 306 and the platen 308. The composition tubes 302 can be formed as a hollow structure having an inner surface 312 and a corresponding outer surface 314. In the illustrated embodiment, the tubes 302 are cylindrical in shape but could in other embodiments have some other suitable shape. The composition tubes 302 can be interconnected together to form a network 310 for transferring composition between the polishing pad 306 and the platen 308. For example, in the embodiment illustrated in FIG. 8, the tubes 302 are arranged in a first plurality of parallel tubes that interconnect with a second plurality of parallel tubes to generally form a grid. However, the tubes can be arranged in any suitable manner and the network 310 of tubes is not to be construed as limited to a grid. The network 310 can be formed as a separable element or can be mounted to either the platen 308 or the polishing pad 306.

The tubes 302 forming the network 310 include a plurality of openings 316 disposed between the inner and the outer surfaces 312, 314 that correspond to the pores 320 in the polishing pad 306. In the illustrated embodiment, the openings 316 are formed at the interconnections between the first and second pluralities of tubes. However, in other embodiments the locations of the openings can vary depending upon the arrangement of the tubes and the network. Additionally, the plurality of pores 320 can be of the same construction as the unidirectional pores described above or a different construction altogether.

To facilitate delivery of the polishing composition from the tubes 302 to the top surface 322 of the polishing pad 306, there is included within the tubes a plurality of protrusions 318. The protrusions 318 can be formed on the inner surface 312 of the tubes aligned opposite the openings 316. In operation, when polishing composition is introduced into the network, the protrusions 318 will redirect at least a portion of the composition through the openings 316 and into the pores 320. As mentioned above, redirecting the polishing composition improves the continuous renewal of the composition at the area of interaction between the substrate and top surface of the pad and, in ECMP applications, promotes uniform ion conduction between the anode and the cathode thereby facilitating the ECMP dissolution of conductive materials from the substrate.

The composition tubes and protrusions can be of any appropriate size for communicating polishing composition in a polishing apparatus. For example, the tubes can have an inner diameter of about 10 micrometers to about 50 micrometers and the protrusions can have a height of about 2 micrometers to about 10 micrometers. Preferably, as a general rule, the height of the protrusions should be about 25% of the width of the tubes. Additionally, in ECMP applications, the composition tubes forming the network can be made of a conductive material and can serve as an electrode for generating the electrical bias necessary for ECMP applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for use with a polishing composition, the polishing pad comprising:

(a) a top surface;

(b) an opposing bottom surface;

(c) a first plurality of unidirectional pores disposed between the top and bottom surfaces and having a non-cylindrical cross-section tapering between the bottom surface and the top surface adapted to communicate the polishing composition from the bottom surface to the top surface; and (d) a second plurality of unidirectional pores disposed between the top and bottom surfaces and having a non-cylindrical cross-section tapering between the top surface and the bottom surface adapted to communicate the polishing composition from the top surface to the bottom surface.

2. The polishing pad of claim 1, wherein the intersection of the pores of the first plurality and the top surface forms a first plurality of apertures, and the intersection of the pores of the second plurality and the top surface forms a second plurality of apertures, an average diameter of the apertures of the first plurality being smaller than an average diameter of the apertures of the second plurality.

3. The polishing pad of claim 2, wherein the intersection of the pores of the first plurality and the bottom surface forms a third plurality of apertures, and the intersection of the pores of the second plurality and the bottom surface forms a fourth plurality of apertures, an average diameter of the apertures of the third plurality being larger than an average diameter of the apertures of the fourth plurality.

4. The polishing pad of claim 3, wherein the apertures of the second and third pluralities have a combined average diameter of about 50micrometers or less.

5. The polishing pad of claim 3, wherein the apertures of the first and fourth pluralities have a combined average diameter of about 20 micrometers or less.

6. The polishing pad of claim 1, wherein at least one of the pores of the first plurality is helically disposed between the top and bottom surface.

7. The polishing pad of claim 1, wherein at least one of the pores of the second plurality is helically disposed between the top and bottom surface.

8. The polishing pad of claim 1, wherein at least one of the pores of the first plurality comprises a series of frusto-conical sections arranged between the top and bottom surface.

9. The polishing pad of claim 8, wherein the frusto-conical sections are axially aligned.

10. The polishing pad of claim 1, wherein at least one of the pores of the second plurality comprises a series of frusto-conical sections arranged between the bottom surface and the top surface.

11. The polishing pad of claim 10, wherein the frusto-conical sections are axially aligned.

12. The polishing pad of claim 1, wherein the top surface includes at least one groove intersecting at least one pore of the first plurality.

13. The polishing pad of claim 12, wherein the groove is V-shaped.

14. The polishing pad of claim 12, wherein the groove intersects at least one pore of the second plurality.

15. The polishing pad of claim 1, wherein the polishing pad is conductive and comprises a maximum resistance value of about 10ohms.

16. The polishing pad of claim 15, wherein the polishing pad comprises a conductive polymer.

17. The polishing pad of claim 1, wherein the polishing pad has an average thickness between the top surface and the bottom surface of about 0.1mm to 10mm.

18. The polishing pad of claim 1, wherein the polishing pad is a multi-layered polishing pad having at least a top layer and a bottom layer, the top layer including the top surface, the bottom surface, and the first and second pluralities of pores.

19. A method of polishing a substrate using a polishing composition comprising:

(i) providing a polishing apparatus including a polishing pad having a top and an opposing bottom surface, and a platen assembly supporting the polishing pad;

(ii) supplying a polishing composition to the top surface via a first plurality of unidirectional pores disposed between the top and bottom surfaces and having a non-cylindrical cross section tapering between the bottom surface and the top surface adapted to communicate polishing composition between the bottom and the top surfaces;

(iii) contacting the top surface with the substrate;

(iv) moving the top surface with respect to the substrate so as to polish at least a portion of the substrate; and (v) removing the polishing composition from the top surface via a second plurality of unidirectional pores disposed between the top and bottom surfaces and having a non-cylindrical cross-section tapering between the top surface and the bottom surface adapted to communicate polishing composition between the top and bottom surfaces.

20. The method of claim 19, further comprising the steps of:

(vi) adapting the polishing composition to act as an electrolytically conductive fluid, said fluid comprising a maximum resistance value of about 100ohms; and (vii) applying an electrochemical potential to the substrate.

21. The method of claim 20, further comprising the steps of:

(viii) injecting the polishing composition between the platen assembly and the bottom surface.

22. The method of claim 19, wherein the moving step comprises orbiting the polishing pad about a fixed point.

23. The method of claim 19, wherein the polishing composition comprises a chemical-mechanical polishing composition.

* * * * *